US011002119B2

(12) United States Patent
Robey et al.

(10) Patent No.: US 11,002,119 B2
(45) Date of Patent: May 11, 2021

(54) ENERGETIC PERFORATOR FILL AND DELAY METHOD

(71) Applicant: HALLIBURTON ENERGY SERVICES, INC., Houston, TX (US)

(72) Inventors: Richard Ellis Robey, Mansfield, TX (US); Jason Paul Metzger, Joshua, TX (US); Brenden Michael Grove, Mansfield, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 16/568,625

(22) Filed: Sep. 12, 2019

(65) Prior Publication Data

US 2020/0392820 A1 Dec. 17, 2020

Related U.S. Application Data

(60) Provisional application No. 62/861,167, filed on Jun. 13, 2019.

(51) Int. Cl.
*E21B 43/1185* (2006.01)
*E21B 43/117* (2006.01)
(Continued)

(52) U.S. Cl.
CPC ..... *E21B 43/1185* (2013.01); *E21B 43/117* (2013.01)

(58) Field of Classification Search
CPC .. E21B 43/1185; E21B 43/117; E21B 43/119; E21B 43/116; E21B 43/11; E21B 29/02; E21B 47/06
See application file for complete search history.

(56) References Cited

U.S. PATENT DOCUMENTS 5,007,344 A * 4/1991 Ricles ..... E21B 23/02 102/312
5,311,819 A 5/1994 Silvia
(Continued)

FOREIGN PATENT DOCUMENTS

CA 2541174 C 12/2012

OTHER PUBLICATIONS

International Search Report and Written Opinion from PCT/US2019/050763, dated Mar. 13, 2020, ISA/KR, pp. 1-15.

*Primary Examiner* — D. Andrews
*Assistant Examiner* — Manuel C Portocarrero
(74) *Attorney, Agent, or Firm* — Haynes and Boone, LLP

(57) ABSTRACT

A method and apparatus according to which a perforating gun includes a first detonation train and a second detonation train. The first detonation train is detonable to perforate a wellbore proximate a subterranean formation. The first detonation train includes a first detonating fuse and a perforating charge ballistically connected to the first detonating fuse. The second detonation train is detonable to increase an internal energy of the perforating gun after detonation of at least a portion of the first detonation train. The second detonation train includes a second detonating fuse ballistically connected to the first detonating fuse. In some embodiments, increasing the internal energy of the perforating gun after detonating the at least a portion of the first detonation train decreases and/or delays pressure drawdown within the wellbore.

21 Claims, 12 Drawing Sheets

(51) Int. Cl.

| | |
|---|---|
| ***E21B 43/119*** | (2006.01) |
| ***E21B 43/116*** | (2006.01) |
| ***E21B 43/11*** | (2006.01) |
| ***E21B 29/02*** | (2006.01) |
| ***E21B 47/06*** | (2012.01) |

(56) References Cited

U.S. PATENT DOCUMENTS

| | | | | |
|---|---|---|---|---|
| 7,165,614 | B1 * | 1/2007 | Bond | E21B 43/117 166/297 |
| 7,913,761 | B2 | 3/2011 | Pratt et al. | |
| 8,127,654 | B2 | 3/2012 | Williams et al. | |
| 10,024,145 | B1 | 7/2018 | Schmidt et al. | |
| 2007/0034369 | A1 | 2/2007 | Ratanasirigulchai et al. | |
| 2010/0147587 | A1 | 6/2010 | Henderson et al. | |
| 2010/0319520 | A1 | 12/2010 | Williams et al. | |
| 2013/0118745 | A1 | 5/2013 | Grove et al. | |
| 2017/0058649 | A1 * | 3/2017 | Geerts | F42D 1/043 |
| 2018/0016879 | A1 | 1/2018 | Harive | |

* cited by examiner

ENERGETIC PERFORATOR FILL AND DELAY METHOD

CROSS-REFERENCE TO RELATED APPLICATION

This application claims the benefit of the filing date of, and priority to, U.S. Patent Application No. 62/861,167, filed Jun. 13, 2019, the entire disclosure of which is hereby incorporated herein by reference.

TECHNICAL FIELD

The present application relates generally to perforating wellbores, and, more particularly, to perforating guns utilizing both perforating explosives and non-perforating explosives for the purpose of raising the internal energy of a perforating gun after the perforating explosives are detonated.

BACKGROUND

Wellbores are typically drilled using a drilling string with a drill bit secured to the lower free end and then completed by positioning a casing string within the wellbore and cementing the casing string in position. The casing string increases the integrity of the wellbore but requires perforation to provide a flow path between the surface and selected subterranean formation(s) for the injection of treating chemicals into the surrounding formation(s) to stimulate production, for receiving the flow of hydrocarbons from the formation(s), and for permitting the introduction of fluids for reservoir management or disposal purposes.

Perforating has conventionally been performed by means of lowering a perforating gun on a carrier down inside the casing string. Once a desired depth is reached across the formation of interest and the gun is secured, it is fired. The gun may have one or many charges thereon which are detonated using a firing control, which may be activated from the surface via wireline or by hydraulic or mechanical means. Once activated, the charge is detonated to perforate (penetrate) the casing, the cement, and to a short distance, the formation. This establishes the desired fluid communication between the inside of the casing and the formation.

Due to a combination of factors, after the perforating charges are detonated, the wellbore is typically at a much higher energy state as compared to the internal volume of the perforating gun. The result of this scenario is a perforating event that creates a high dynamic underbalance in the wellbore, possibly resulting in sanding or tunnel collapse. To reduce excessive drawdown within the wellbore, an additional energy source contained within the perforating gun is desirable.

DETAILED DESCRIPTION

Figure 1A:
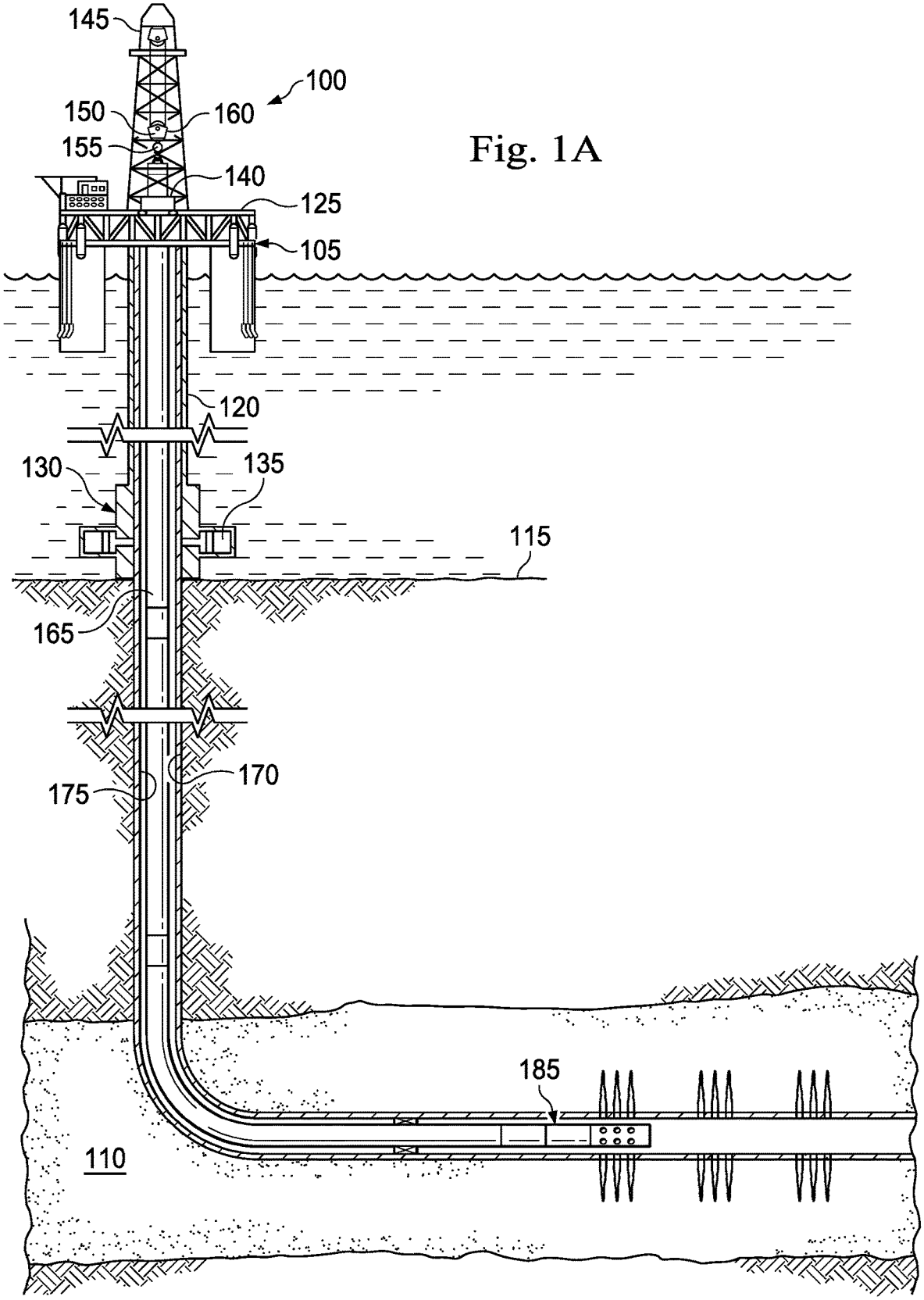
FIG. 1A is an elevational view of an offshore oil and gas platform operably coupled to a subsurface well system, according to one or more embodiments of the present disclosure.

A hollow-carrier perforating gun used in service operations for perforating a formation may generally include an elongated tubular outer housing in the form of a carrier tube within which is received an elongated tubular structure in the form of a charge tube. Explosive perforating charges are mounted in the charge tube and are ballistically connected together via explosive detonating cord. The charge tube is located relative to the carrier tube to align the shaped perforating charges with reduced-thickness sections of the carrier tube. In some instances, such perforating guns are unable to effectively perforate a well with high pore pressures using a low shot density perforating gun. For example, such wells may need to be perforated in a completion scheme that does not necessarily require high flow area but does require a certain threshold of connectivity between the wellbore and the formation.

Due to a combination of factors, after the perforating charges are detonated, the wellbore may be at a much higher energy state as compared to the internal volume of the perforating gun. Such factors may include, but are not limited to, high wellbore pressure, low shot density, a low amount of internal volume fill for the perforating gun, and/or high temperature explosives. The result of this scenario is a perforating event that creates a high dynamic underbalance in the wellbore, possibly resulting in sanding or tunnel collapse. To reduce excessive drawdown within the wellbore, an additional energy source contained within the perforating gun is desirable. However, lowered functionality and increased risk of decomposition at elevated temperatures (e.g., around 325° F.) has been observed for the propellant (e.g., potassium perchlorate resin) typically used in oil and gas perforating guns.

The present disclosure introduces a wellbore perforating system utilizing both perforating explosives and non-perforating explosives for the purpose of raising the internal energy of a perforating gun after the perforating explosives are detonated. Specifically, the wellbore perforating system utilizes a main detonation train to initiate the perforating explosives and auxiliary detonation train(s) to initiate the non-perforating explosives, which can increase the magnitude and/or duration of internal energy release within the perforating gun, thereby bringing the internal energy of the perforating gun closer to the energy state of the wellbore after the perforating explosives are detonated. Ideally, this is achieved by adding discrete or continuous auxiliary detonation train(s) that do not obstruct the formation of shaped charge jets by the perforating explosives or otherwise interfere with the main detonation train. As a result, the wellbore perforating system reduces excessive drawdown within the wellbore to prevent, or at least reduce, dynamic underbalance in the wellbore, sanding, and/or tunnel collapse. In addition, or instead, the wellbore perforating system is able to effectively perforate a well with high pore pressures using a low shot density perforating gun.

FIG. 1A is an elevational view of an offshore oil and gas platform operably coupled to a subsurface well system, according to one or more embodiments of the present disclosure. Referring to FIG. 1A, in an embodiment, the offshore oil and gas rig is schematically illustrated and generally referred to by the reference numeral 100. In an embodiment, the offshore oil and gas rig 100 includes a semi-submersible platform 105 that is positioned over a submerged oil and gas formation 110 located below a sea floor 115. A subsea conduit 120 extends from a deck 125 of the platform 105 to a subsea wellhead installation 130. One or more pressure control devices 135, such as, for example, blowout preventers (BOPs), and/or other equipment associated with drilling or producing a wellbore may be provided at the subsea wellhead installation 130 or elsewhere in the system. The platform 105 may also include a hoisting apparatus 140, a derrick 145, a travel block 150, a hook 155, and a swivel 160, which components are together operable for raising and lowering a conveyance string 165. The conveyance string 165 may be, include, or be part of, for example, a casing, a drill string, a completion string, a work string, a pipe joint, coiled tubing, production tubing, other types of pipe or tubing strings, and/or other types of conveyance strings, such as wireline, slickline, and/or the like. The platform 105 may also include a kelly, a rotary table, a top drive unit, and/or other equipment associated with the rotation and/or translation of the conveyance string 165. A wellbore 170 extends from the subsea wellhead installation 130 and through the various earth strata, including the submerged oil and gas formation 110. At least a portion of the wellbore 170 includes a casing 175 secured therein by cement 180 (not visible in FIG. 1A; shown in FIG. 1B). The conveyance string 165 is, includes, or is operably coupled to a wellbore perforating system 185 installed within the wellbore 170 and adapted to perforate the casing 175, the cement 180, and the wellbore 170 proximate the submerged oil and gas formation 110.

Figure 1B:
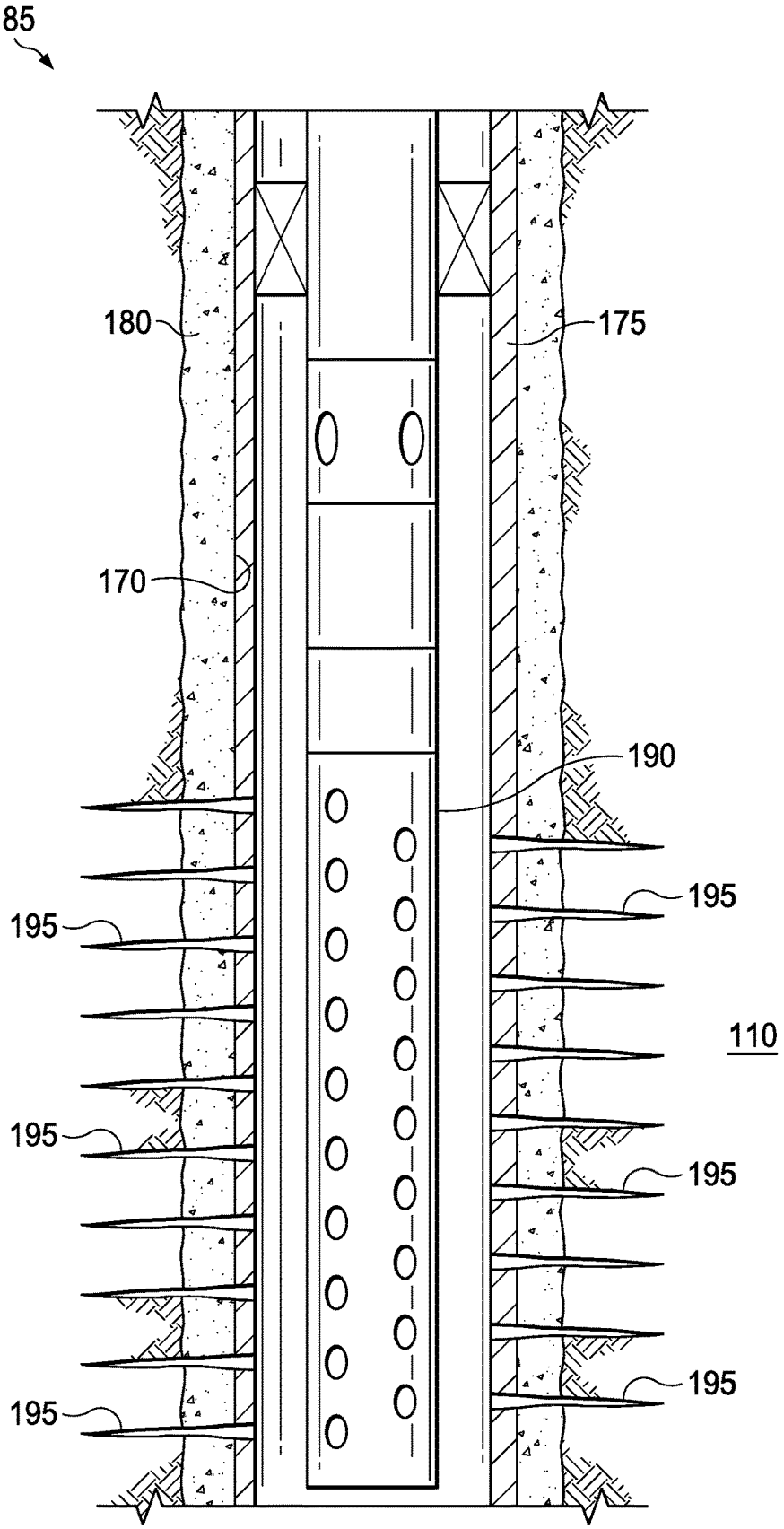
FIG. 1B is an enlarged elevational view of a perforating gun of the well system of FIG. 1A, according to one or more embodiments of the present disclosure.

FIG. 1B is an enlarged elevational view of a perforating gun of the well system of FIG. 1A, according to one or more embodiments of the present disclosure. Referring to FIG. 1B, in some embodiments, the wellbore perforating system 185 of FIG. 1A includes a perforating gun 190 that extends within the wellbore 170, which wellbore is lined with the casing 175 and the cement 180. The perforating gun 190 is operable to form perforations 195 through the casing 175 and the cement 180 so that fluid communication is established between the casing 175 and the submerged oil and gas formation 110 surrounding the wellbore 170. More particularly, the perforating gun 190 includes perforating charges 200 (as best shown in FIG. 2C) that are detonatable to form the perforations 195 through the casing 175 and the cement 180. In some systems, after the perforating charges 200 are detonated, there can be a reduction in wellbore pressure due to wellbore fluids flowing into the (detonated) perforating gun 190. The perforating gun 190 of the present disclosure addresses this issue by preventing, or at least reducing, the reduction of pressure in the wellbore 170 following detonation of the perforating charges 200, as described in further detail below. In various embodiments, one or more components of the perforating gun 190 described herein can be integrated with one or more other components of the perforating gun 190. Accordingly, other perforating guns that do not include each and every component of the perforating gun 190 described herein may nevertheless fall within the scope of the present disclosure.

Figure 2A:
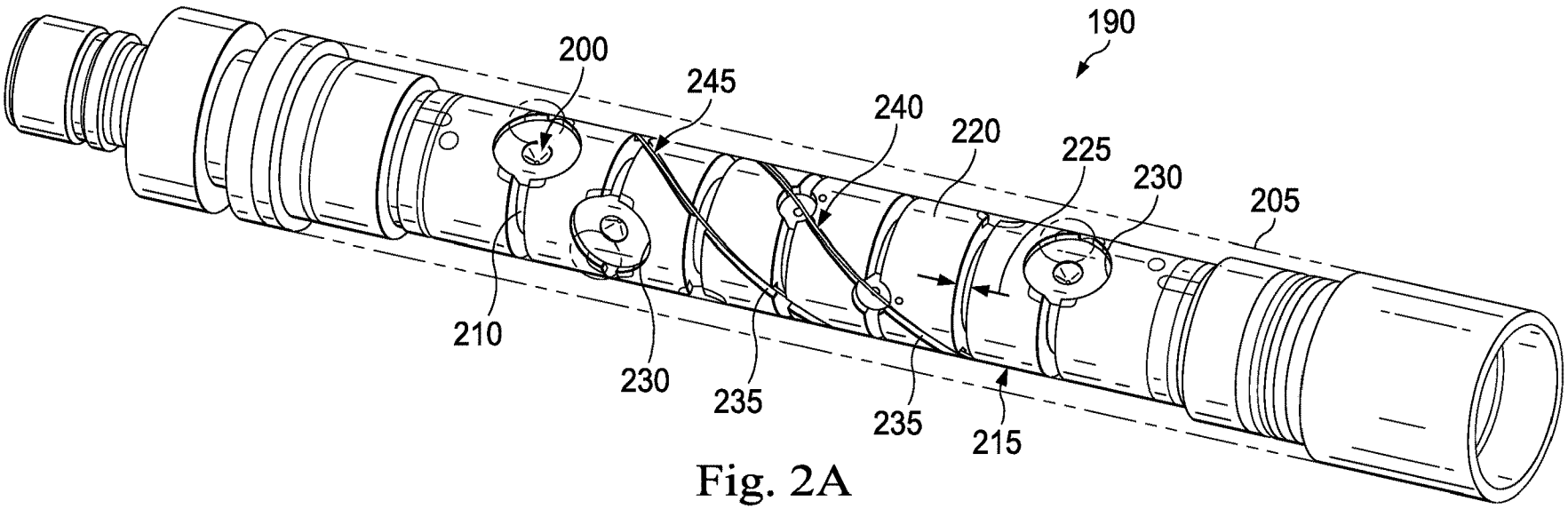
FIG. 2A is a perspective view of the perforating gun of FIG. 1B, said perforating gun including a main detonation train and auxiliary detonation train(s), according to one or more embodiments of the present disclosure.

FIG. 2A is a perspective view of the perforating gun of FIG. 1B, said perforating gun including a main detonation train and auxiliary detonation train(s), according to one or more embodiments of the present disclosure. Referring to FIG. 2A, the perforating gun 190 includes a carrier tube 205 and a charge tube 210 (best shown in FIG. 2C), in which the perforating charges 200 are mounted, disposed within the carrier tube 205. A fill body 215 is positioned (e.g., annularly) between the charge tube 210 and the carrier tube 205. The fill body 215 is divided into divider segments 220. While adjacent ones of the divider segments 220 may abut one another, in some embodiments, gaps 225 (best shown in FIG. 2B) are instead formed between adjacent ones of the divider segments 220. Adjacent ones of the divider segments 220 may be shaped to cooperate with one another so as to form recesses 230 (e.g., cut-outs). In this regard, in some embodiments, the divider segments 220 each overlap a pair of the perforating charges 200. For example, each of the divider segments 220 may be disposed axially along the charge tube 210 between successive ones of the perforating charges 200. Accordingly, each of the divider segments 220 may include partial recesses formed at opposing end portions thereof so that the partial recesses of adjacent ones of the divider segments 220 together make up one of the recesses 230 over a corresponding one of the perforating charges 200.

In addition to the recesses 230, one or more of the divider segments 220 may include grooves 235 formed therein between the opposing end portions thereof. The grooves 235 allow two or more detonation trains to extend across the fill body 215, as described in more detail below. In some instances, the perforating charges 200 are generally helically arranged along the length of the perforating gun 190, and, therefore, the grooves 235 may likewise extend helically along each of the divider segments 220 from one end to the other, such that when a plurality of the divider segments 220 are positioned adjacent one another, helical paths for the two or more detonation trains are formed along at least a portion of the length of the perforating gun 190.

Figure 2B:
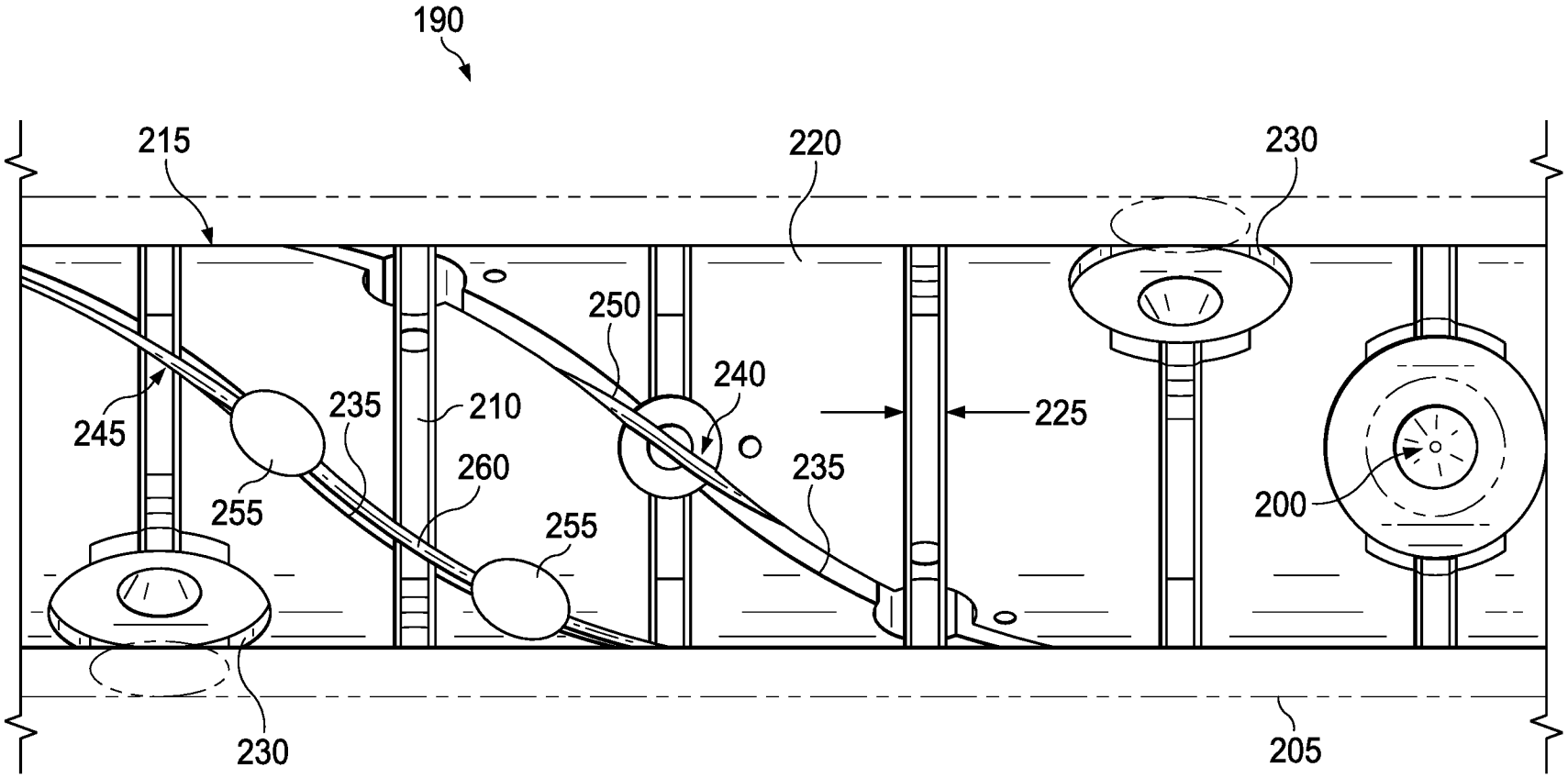
FIG. 2B is an elevational view of the perforating gun of FIG. 2A, according to one or more embodiments of the present disclosure.
Figure 2C:
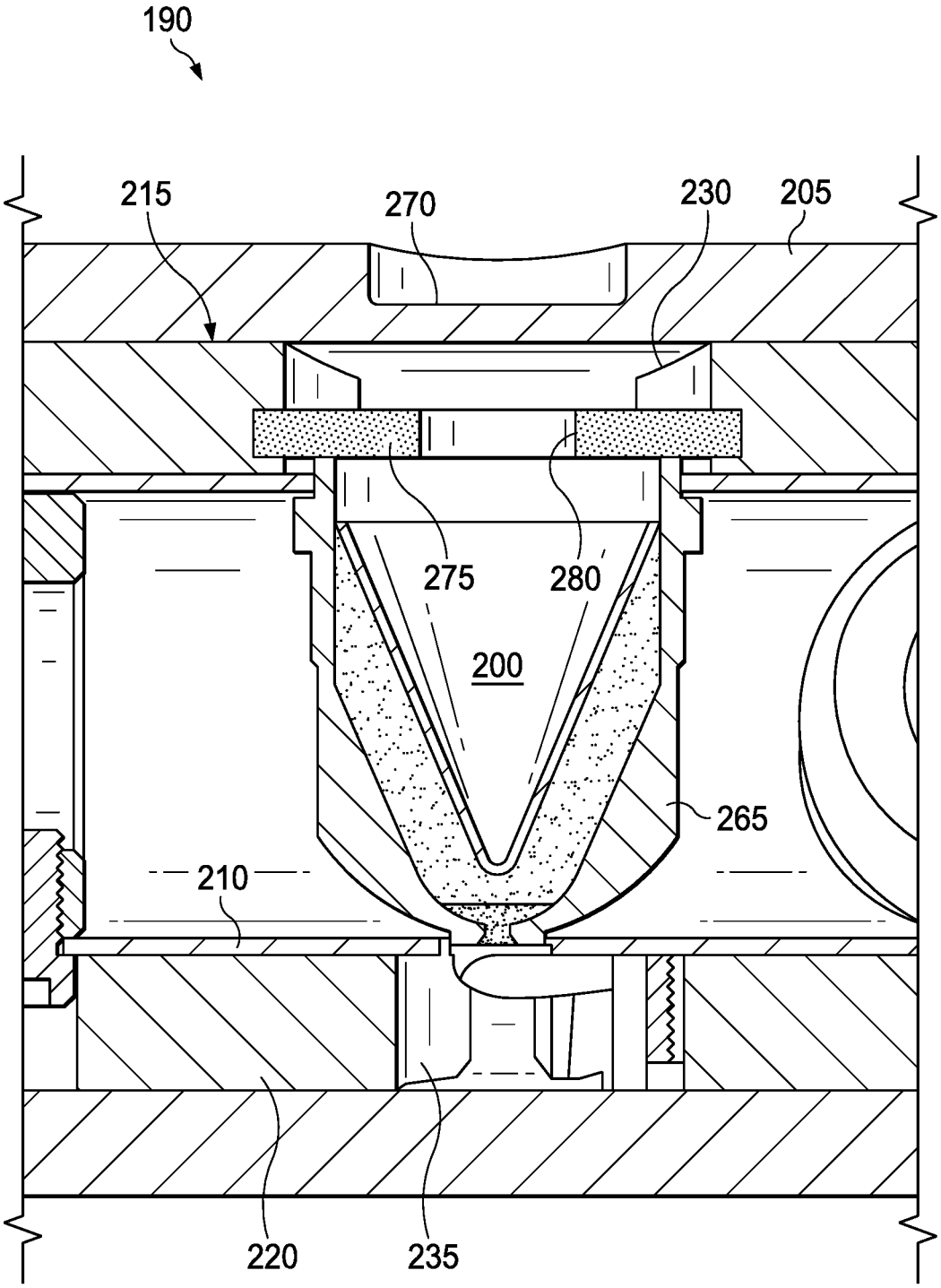
FIG. 2C is a cross-sectional view of the perforating gun of FIG. 2B, according to one or more embodiments of the present disclosure.

FIG. 2B is an elevational view of the perforating gun of FIG. 2A, according to one or more embodiments of the present disclosure. Referring to FIG. 2B, in some embodiments, the divider segments 220 are configured to limit exposure of the two or more detonation trains to each other. More particularly, in some embodiments, the perforating gun 190 includes a main detonation train 240 and auxiliary detonation train(s) 245 extending within the respective grooves 235. The main detonation train 240 is adapted explicitly for detonation of the perforating charges 200. Specifically, the main detonation train 240 ballistically links the perforating charges 200 using a detonating fuse 250 (e.g., a detonating cord). In some embodiments, the perforating charges 200 are at least partially received by the divider segments 220. In contrast, the auxiliary detonation train(s) 245 is/are adapted to detonate a series of secondary energetic devices 255. Specifically, the auxiliary detonation train(s) 245 include additional explosive charges (i.e., the secondary energetic devices 255) adapted to be fired following a ballistic delay after detonation of the perforating charges 200. In some embodiments, the auxiliary detonation train(s) 245 include a detonating fuse 260 (e.g., single path detonating cord or other explosive formed into one of the grooves 235) and additional discrete charges (e.g., the secondary energetic devices 255) ballistically linked by said detonating fuse 260. Although a corded explosive is shown linking the secondary energetic devices 255, other suitable variations may be utilized for the auxiliary detonation train (s) 245. For example, a poorly confined low-density strip of explosives (i.e., having a detonation velocity below that of a heavily confined high-density explosive) could be used. For another example, a mild detonating fuse could be substituted in place of the corded explosive, creating lower speed auxiliary detonation train(s) 245 when compared to the main detonation train 240 (e.g., 4000 m/s versus 6400 m/s). In any case, the corded explosive, the low-density strip of explosives, the mild detonating fuse, the like, or a combination thereof are used to interconnect the discrete secondary energetic devices 255 to form the auxiliary detonation train(s) 245.

FIG. 2C is a cross-sectional view of the perforating gun of FIG. 2B, according to one or more embodiments of the present disclosure. Referring to FIG. 2C, with continuing reference to FIGS. 2A and 2B, a cross-sectional side view of the perforating gun 190 is illustrated. The charge tube 210 is shown generally axially aligned within the carrier tube 205. Disposed between the charge tube 210 and the carrier tube 205 are the divider segments 220. A charge carrier 265 may at least partially extend from the charge tube 210 for each of the perforating charges 200. The recesses 230 formed in the fill body 215 may be shaped to accommodate the respective charge carriers 265 at least partially extending from the charge tube 210. Moreover, the respective charge carriers 265 are disposed to receive the perforating charges 200 for detonation. Gun ports such as, for example, scallops 270 (i.e., thin-walled recessed areas) may be formed in the carrier tube 205 and radially and axially aligned with each of the respective perforating charges 200. In some embodiments, the recesses 230 may be aligned with respective ones of the scallops 270 formed in the carrier tube 205. As best shown in FIG. 2C, the perforating gun 190 includes energetic donuts 275 proximate the perforating charges 200. The energetic donuts 275 may be deployed in the recesses 230 and each include a centrally located aperture 280 to allow jet passage. The energetic donuts 275 are configured to be ignited by the perforating charges 200. For example, ignition of the energetic donuts 275 may be delayed by approximately 30 μs after detonation of the perforating charges 200. As a result of such ignition, the energetic donuts 275 add internal energy to the perforating gun 190. However, the energetic donuts 275 will not create a significantly long transient unless made of poorly confined or low-density detonable material.

The main detonation train 240 and the auxiliary detonation train(s) 245 may be separate so as to increase the overall detonation impulse magnitude and/or duration of the perforating gun 190. Specifically, the overall detonation impulse magnitude of the perforating gun 190 may be increased via: a ballistic delay between detonation of the main detonation train 240 and the auxiliary detonation train(s) 245; adding length to the detonating fuse(s) 260 of the auxiliary detonation train(s) 245 or piggybacking several of the detonating fuses 260 in one or the grooves 235; adding the energetic donuts 275 proximate the perforating charges 200 to increase the net explosive weight within the perforating gun 190; adding a series of explosive pucks (e.g., the secondary energetic devices 255) around the fill body 215 in contact with the detonating fuse(s) 260 of the auxiliary detonation train(s) 245; the like; and/or a combination thereof. Additionally, increased duration can be achieved by adding separate length(s) of the detonating fuse(s) 260 to the auxiliary detonation train(s) 245 that is/are detonated after the main detonation train 240 (or a portion thereof) is detonated. These additional lengths of the detonating fuse(s) 260 may contain ballistically connected discrete explosive charges (e.g., the secondary energetic devices 255).

Figure 3A:
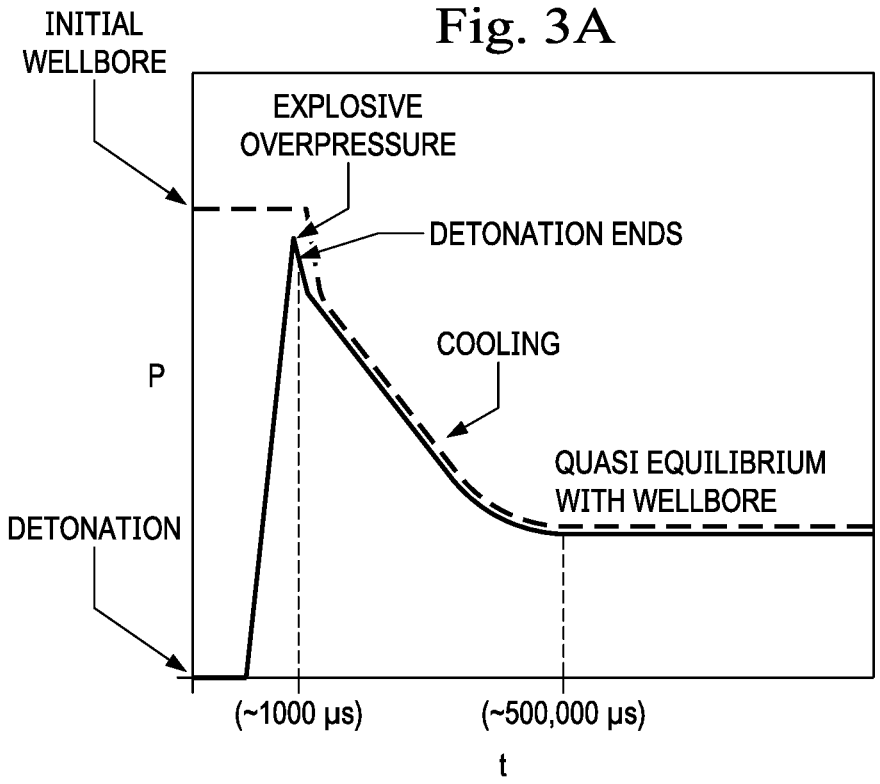
FIG. 3A is a pressure over time graph of a single gun pressure transient in which wellbore pressure is much greater than an internal explosive pressure of a perforating gun, according to one or more embodiments of the present disclosure.

FIG. 3A is a pressure over time graph of a single gun pressure transient in which wellbore pressure is much greater than an internal explosive pressure of a perforating gun, according to one or more embodiments of the present disclosure. Specifically, FIG. 3A shows a single gun pressure transient in which wellbore pressure is much greater than the perforating gun 190's internal explosive pressure.

Figure 3B:
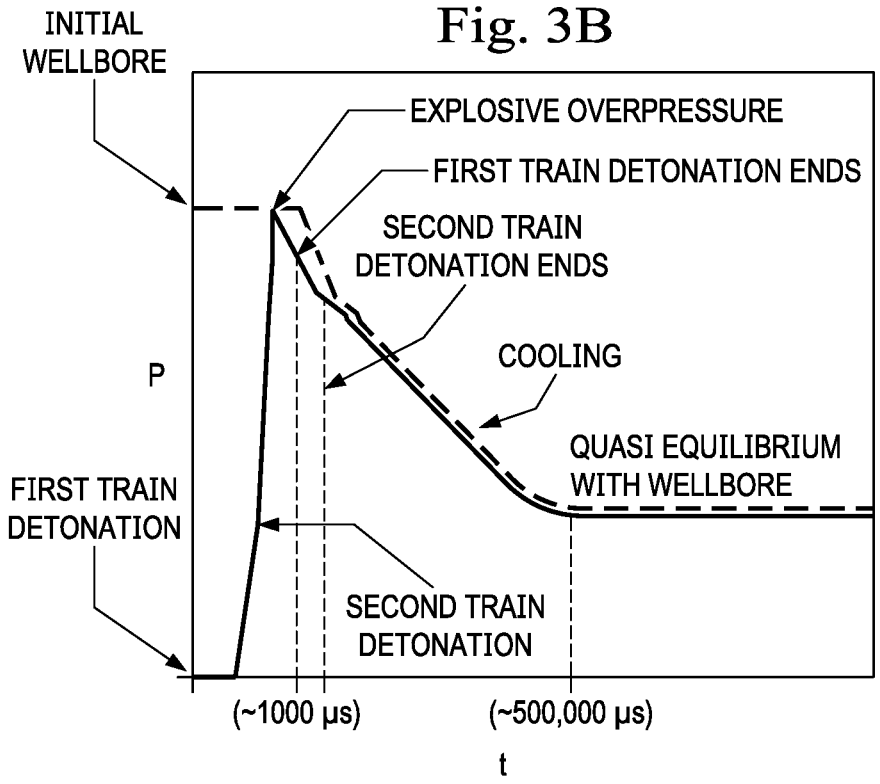
FIG. 3B is a pressure over time graph of an extended duration pressure transient in which wellbore pressure is only slightly greater than an internal explosive pressure of the perforating gun, according to one or more embodiments of the present disclosure.

FIG. 3B is a pressure over time graph of an extended duration pressure transient in which wellbore pressure is only slightly greater than an internal explosive pressure of the perforating gun, according to one or more embodiments of the present disclosure. In some instances, implementation of the main detonation train 240 and the auxiliary detonation trains in the wellbore perforating system 185 allows for the perforating charges 200 to have relatively low energy in high-energy environments, as illustrated in FIG. 3B. Specifically, FIG. 3B shows an extended duration pressure transient in which wellbore pressure is only slightly greater than the perforating gun 190's internal explosive pressure.

Figure 4:
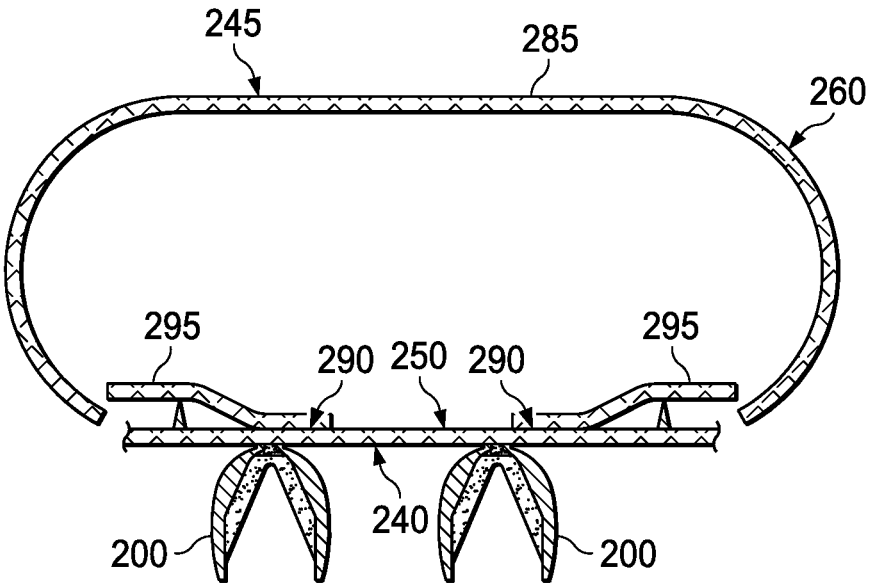
FIG. 4 is an elevational view of an auxiliary detonation train of the perforating gun including an initially bi-directional detonable delay loop, according to one or more embodiments of the present disclosure.

FIG. 4 is an elevational view of an auxiliary detonation train of the perforating gun including an initially bi-directional detonable delay loop, according to one or more embodiments of the present disclosure. Referring to FIG. 4, to ensure that the main detonation train 240 and the auxiliary detonation train(s) 245 are not detonated simultaneously, each of the auxiliary detonation train(s) 245 may be or include one or more initially bi-directional detonable delay loops. One such auxiliary detonation train 245 including an initially bi-directional detonable delay loop 285 is shown in FIG. 4. The detonable delay loop 285 is in contact with the main detonation train 240 via detonable overlaps 290. Multiple energetic devices (e.g., the secondary energetic devices 255) (not visible in FIG. 4) could exist along the detonable delay loop 285. Alternatively, the detonable delay loop 285 may instead have a high enough energetic content per unit length so as to not require the multiple energetic devices in some instances. The arrangement of FIG. 4 is symmetric from left to right and includes severing mechanisms 295 adapted to sever part of the detonable delay loop 285 after a detonation wave passes from the main detonation train 240 to the auxiliary detonation train 245. The severing mechanism may be a flyer, blocking geometry, a small stabbing element driven by detonation of the main detonation train 240, the like, or a combination thereof. As a result of such severing, a detonable path is eliminated in one direction on the detonable delay loop 285. Failure to eliminate this detonable path may result in only a small delay between detonation of the main detonation train 240 and the auxiliary detonation train 245 (due to "backtrack" detonation of the detonable delay loop 285).

Figure 5A:
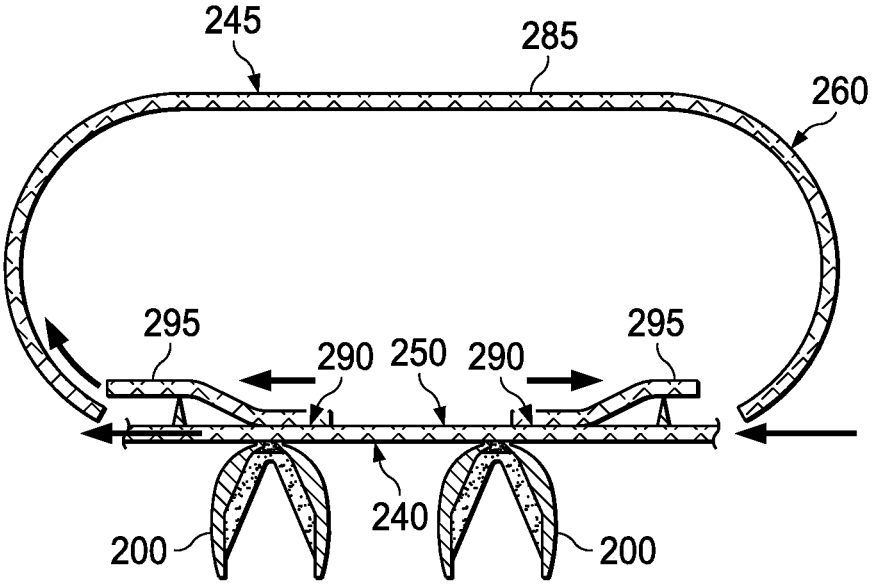
FIG. 5A is an elevational view of the initially bi-directional detonable delay loop of FIG. 4 as it becomes unidirectional after being acted on by a right-to-left travelling detonation wave, according to one or more embodiments of the present disclosure.

FIG. 5A is an elevational view of the initially bi-directional detonable delay loop of FIG. 4 as it becomes unidirectional after being acted on by a right-to-left travelling detonation wave, according to one or more embodiments of the present disclosure. Specifically, FIG. 5A shows a right-to-left traveling detonation.

Figure 5B:
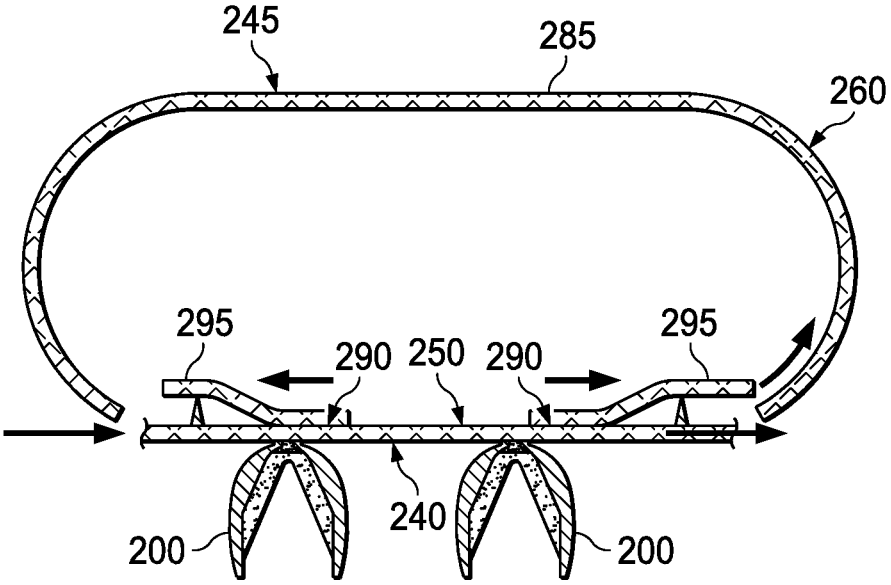
FIG. 5B is an elevational view of the initially bi-directional detonable delay loop of FIG. 4 as it becomes unidirectional after being acted on by a left-to-right travelling detonation wave, according to one or more embodiments of the present disclosure.

FIG. 5B is an elevational view of the initially bi-directional detonable delay loop of FIG. 4 as it becomes unidirectional after being acted on by a left-to-right travelling detonation wave, according to one or more embodiments of the present disclosure. Specifically, FIG. 5B shows a left-to-right traveling detonation.

Figure 6:
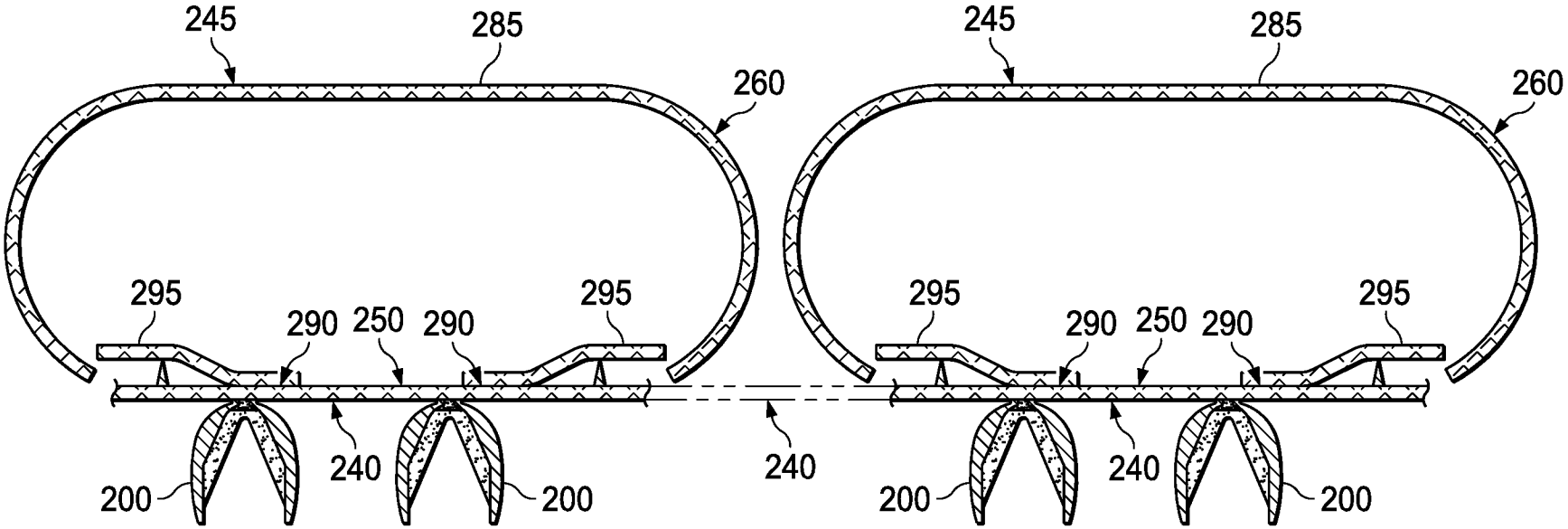
FIG. 6 is an elevational view of several of the detonable delay loops of FIG. 4 running in parallel with a main detonation train, according to one or more embodiments of the present disclosure.

FIG. 6 is an elevational view of several of the detonable delay loops of FIG. 4 running in parallel with a main detonation train, according to one or more embodiments of the present disclosure. The length of the detonable delay loop 285 must be appropriately sized so that firing of the auxiliary detonation train(s) 245: does not interfere with the shaped charge jets of the perforating charges 200 (e.g., at least a 60 μs delay from the closest perforating charge 200) in the main detonation train 240; and occurs before substantial cooling or venting of the perforating gun 190 in the region of interest (this can take about 500-1000 μs for the first perforating charge 200 in the main detonation train 240 to interact with the wellbore 170). Due to these considerations, the detonable delay loop 285 can be broken up along a length of the perforating gun 190 so that several of the detonable delay loops 285 run in parallel with the continuous main detonation train 240, as illustrated in FIG. 6.

Figure 7:
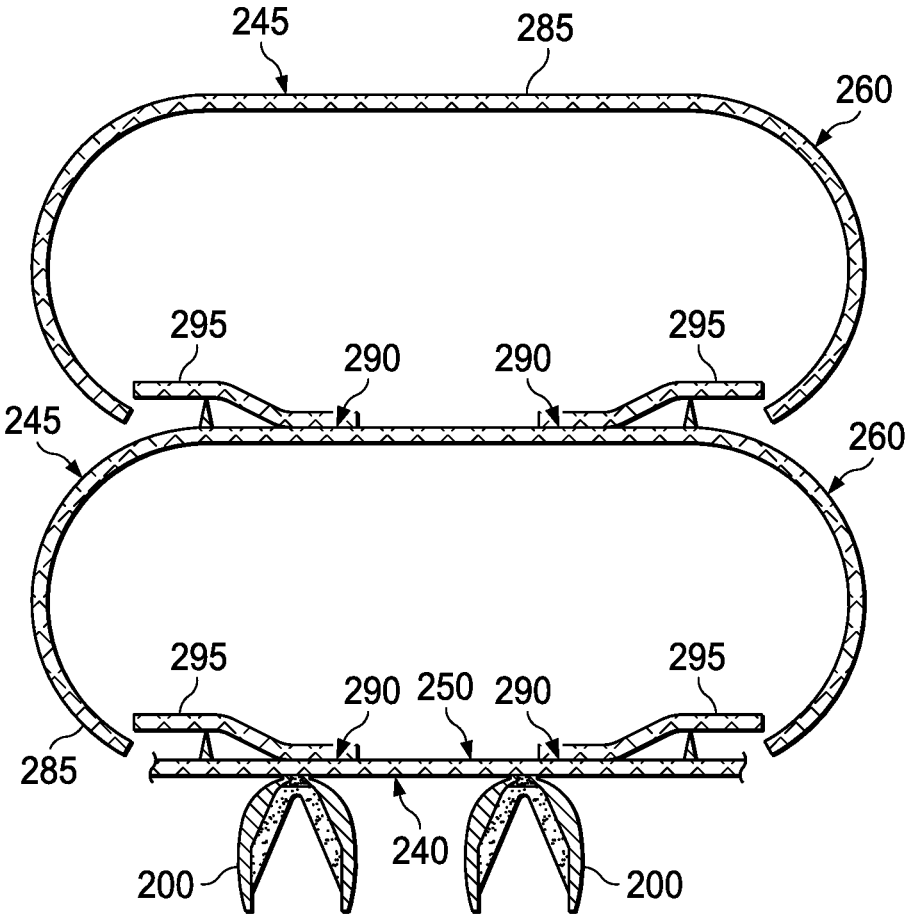
FIG. 7 is an elevational view of several of the detonable delay loops of FIG. 4 running in series with a main detonation train, according to one or more embodiments of the present disclosure.

FIG. 7 is an elevational view of several of the detonable delay loops of FIG. 4 running in series with a main detonation train, according to one or more embodiments of the present disclosure. Due to the above considerations, the detonable delay loop 285 can be broken up along a length of the perforating gun 190 so that several of the detonable delay loops 285 run in series with the continuous main detonation train 240, as illustrated in FIG. 7.

Figure 8:
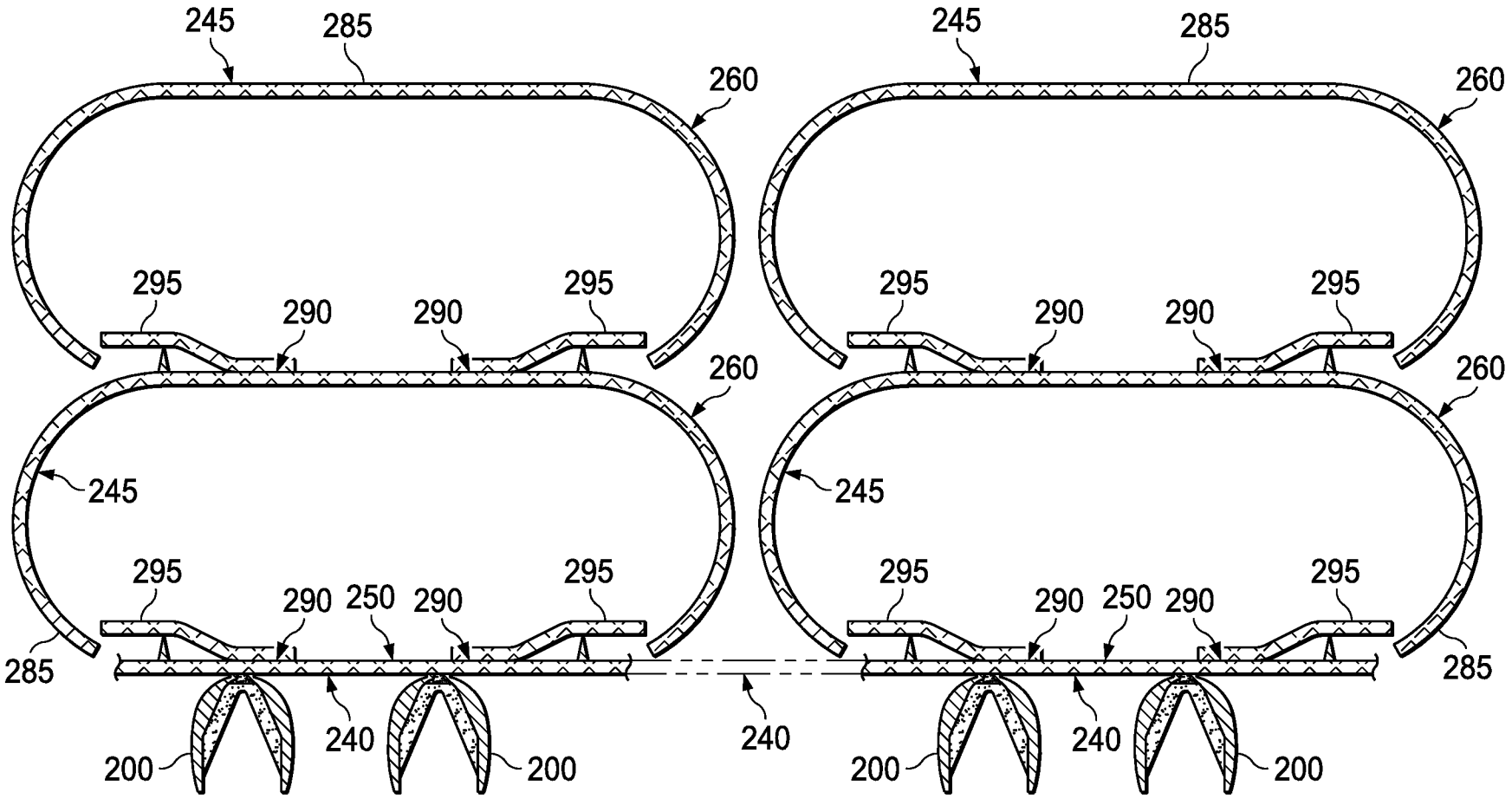
FIG. 8 is an elevational view of several of the detonable delay loops of FIG. 4 running in parallel with a main detonation train and several of the detonable delay loops of FIG. 4 running in series with the main detonation train, according to one or more embodiments of the present disclosure.

FIG. 8 is an elevational view of several of the detonable delay loops of FIG. 4 running in parallel with a main detonation train and several of the detonable delay loops of FIG. 4 running in series with the main detonation train, according to one or more embodiments of the present disclosure. Due to the above considerations, the detonable delay loop 285 can be broken up along a length of the perforating gun 190 so that several of the detonable delay loops 285 run in parallel with the continuous main detonation train 240 and several of the detonable delay loops 285 run in series with the continuous main detonation train 240, as illustrated in FIG. 8.

Figure 9:
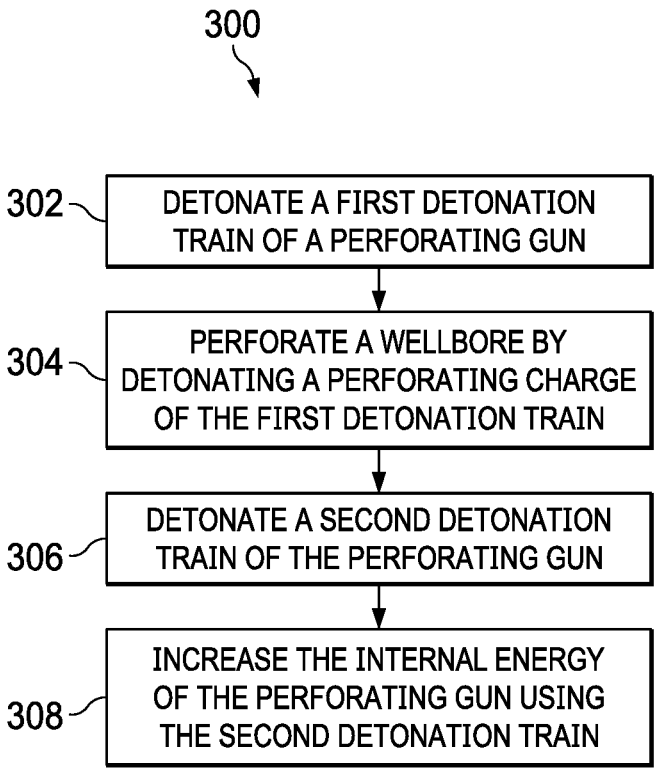
FIG. 9 is a flow diagram of a method for implementing one or more embodiments of the present disclosure.

FIG. 9 is a flow diagram of a method for implementing one or more embodiments of the present disclosure. Referring to FIG. 9, a method for delaying or decreasing pressure drawdown in a wellbore after perforating charges are detonated is generally referred to by the reference numeral 300. The method 300 includes, at a step 302, detonating a first detonation train of a perforating gun. Optionally, the step 302 includes activating a first detonating fuse to initiate the detonation of the first detonation train. For example, the first detonating fuse may be activated remotely such as by wireline or by hydraulic or mechanical means. The method 300 also includes, at a step 304, perforating a wellbore by detonating a perforating charge of the first detonation train. In this regard, the step 304 may include exploding, in response to the activating of the first detonating fuse, the perforating charge, which perforating charge is ballistically connected to the first detonating fuse. The method 300 also includes, at a step 306, detonating a second detonation train of the perforating gun. In this regard, the step 306 may include activating a second detonating fuse of the second detonation train and/or detonating one or more detonable delay loops of the second detonation train in parallel and/or in series with the first detonation train. The method 300 also includes, at a step 308, increasing the internal energy of the perforating gun using the second detonation train. In this regard, the step 308 may include exploding, in response to activating the second detonating fuse, a secondary energetic device ballistically connected to the second detonating fuse. In addition, or instead, the step 308 may involve the second detonating fuse itself releasing sufficient energy to delay or decrease pressure drawdown in the wellbore.

Notably, the second detonating fuse may be activated by detonating a portion of the first detonation train, as may be the case when the first and second detonating fuses include detonation cord, portions of which overlap. With respect to the method 300, it should then be appreciated that the step 306 may be executed prior to, simultaneously with, or after execution of the step 304. In this regard, the second detonating fuse may be positioned with respect to the first detonation train such that the first detonation train activates the second detonating fuse at a location along the length of the first detonation train selected to provide desired timing between the exploding of one or more of the perforating charges and the increasing of the internal energy of the perforating gun thereafter. Further in this regard, the end of the second detonation train activated by the first detonation train may be disposed before all of the perforating charges, between the perforating charges, or after all of the perforating charges, depending upon the speeds at which the respective detonation trains detonate. Moreover, the second detonation train may be segmented and disposed at various locations along the length of the first detonation train.

A perforating gun has been disclosed. The perforating gun generally includes a first detonation train including: a first detonating fuse; and a perforating charge, ballistically connected to the first detonating fuse and detonable by the first detonating fuse to perforate a wellbore proximate a subterranean formation; and a second detonation train that is detonable to increase an internal energy of the perforating gun after detonation of at least a portion of the first detonation train, the second detonation train including a second detonating fuse. In other embodiments, the perforating gun generally includes: a perforating charge detonable to perforate a wellbore proximate a subterranean formation; and an energetic donut including a poorly confined or low-density detonable material, the energetic donut disposed between the perforating charge and the subterranean formation and configured to be ignited by the perforating charge to add internal energy to the perforating gun after detonation of the perforating charge.

The foregoing perforating gun embodiments may include one or more of the following elements, either alone or in combination with one another:

the second detonating fuse is ballistically connected to the first detonating fuse and is configured to be detonated by the first detonating fuse;

the second detonating fuse includes a bi-directional detonable delay loop that is adapted to become unidirectional in response to a detonation wave caused by the first detonating fuse;

the perforating gun further includes a severing mechanism activatable by the detonation wave to sever a portion of the bi-directional detonable delay loop to cause the bi-directional detonable delay loop to become unidirectional;

the second detonation train further includes a secondary energetic device ballistically connected to the second detonating fuse, wherein the secondary energetic device is configured to be detonated after the perforating charge is detonated;

the second detonation train is configured to detonate the secondary energetic device not less than about 60 μs and not more than about 500 μs after the perforating charge is detonated;

the second detonating fuse has an energetic content per unit length capable of increasing the internal energy of the perforating gun after detonation of at least the perforating charge;

the perforating gun further includes: a charge tube housing the perforating charge; a carrier tube in which the charge tube extends; and a fill body extending within a space defined between the charge tube and the carrier tube;

the fill body includes a first groove in which the first detonating fuse is disposed and a second groove in which the second detonating fuse is disposed;

the second detonation train includes a plurality of detonable delay loops arranged in parallel and/or series with the first detonation train;

one or more of the plurality of detonable delay loops is ballistically connected to one or more secondary energetic devices configured to be detonated after the perforating charge is detonated;

the first detonating fuse includes detonating cord;

the second detonating fuse includes a poorly confined low-density strip of explosives or a mild detonating fuse.

A method has also been disclosed. The method generally includes: detonating at least a portion of a first detonation train of a perforating gun; perforating, with the first detonation train, a wellbore proximate one or more subterranean formations; detonating, after detonating the at least a portion of the first detonation train, a second detonation train of the perforating gun; and increasing, with the second detonation train, an internal energy of the perforating gun.

The foregoing method embodiment may include one or more of the following elements, either alone or in combination with one another:

detonating the at least a portion of the first detonation train of the perforating gun includes activating a first detonating fuse of the first detonation train; and perforating the wellbore includes exploding, in response to activating of the first detonating fuse, a perforating charge ballistically connected to the first detonating fuse;

detonating the second detonation train of the perforating gun includes: activating a second detonating fuse of the second detonation train;

increasing the internal energy of the perforating gun includes: exploding, in response to activating the second detonating fuse, a secondary energetic device ballistically connected to the second detonating fuse;

activating the second detonating fuse includes: detonating one or more detonable delay loops of the second detonation train in parallel and/or in series with the first detonation train;

the second detonating fuse is activated by detonating the at least a portion of the first detonation train.

It is understood that variations may be made in the foregoing without departing from the scope of the present disclosure.

In some embodiments, the elements and teachings of the various embodiments may be combined in whole or in part in some or all of the embodiments. In addition, one or more of the elements and teachings of the various embodiments may be omitted, at least in part, and/or combined, at least in part, with one or more of the other elements and teachings of the various embodiments.

Any spatial references, such as, for example, "upper," "lower," "above," "below," "between," "bottom," "vertical," "horizontal," "angular," "upwards," "downwards," "side-to-side," "left-to-right," "right-to-left," "top-to-bottom," "bottom-to-top," "top," "bottom," "bottom-up," "top-down," etc., are for the purpose of illustration only and do not limit the specific orientation or location of the structure described above.

In some embodiments, while different steps, processes, and procedures are described as appearing as distinct acts, one or more of the steps, one or more of the processes, and/or one or more of the procedures may also be performed in different orders, simultaneously and/or sequentially. In some embodiments, the steps, processes, and/or procedures may be merged into one or more steps, processes and/or procedures.

In some embodiments, one or more of the operational steps in each embodiment may be omitted. Moreover, in some instances, some features of the present disclosure may be employed without a corresponding use of the other features. Moreover, one or more of the above-described embodiments and/or variations may be combined in whole or in part with any one or more of the other above-described embodiments and/or variations.

Although several embodiments have been described in detail above, the embodiments described are illustrative only and are not limiting, and those skilled in the art will readily appreciate that many other modifications, changes and/or substitutions are possible in the embodiments without materially departing from the novel teachings and advantages of the present disclosure. Accordingly, all such modifications, changes, and/or substitutions are intended to be included within the scope of this disclosure as defined in the following claims. In the claims, any means-plus-function clauses are intended to cover the structures described herein as performing the recited function and not only structural equivalents, but also equivalent structures. Moreover, it is the express intention of the applicant not to invoke 35 U.S.C. § 112, paragraph 6 for any limitations of any of the claims herein, except for those in which the claim expressly uses the word "means" together with an associated function.

What is claimed is:

1. A perforating gun, comprising:

a first detonation train comprising:

a first detonating fuse; and a perforating charge, ballistically connected to the first detonating fuse and detonable by the first detonating fuse to perforate a wellbore proximate a subterranean formation; and a second detonation train that is detonable to increase an internal energy of the perforating gun after detonation of at least a portion of the first detonation train, the second detonation train comprising a second detonating fuse;

wherein the second detonating fuse is ballistically connected to the first detonating fuse and is configured to be detonated by the first detonating fuse; and wherein the second detonating fuse comprises a bi-directional detonable delay loop that is adapted to become unidirectional in response to a detonation wave caused by the first detonating fuse.

2. The perforating gun of claim 1, further comprising a severing mechanism activatable by the detonation wave to sever a portion of the bi-directional detonable delay loop to cause the bi-directional detonable delay loop to become unidirectional.

3. The perforating gun of claim 1, wherein the second detonation train further comprises a secondary energetic device ballistically connected to the second detonating fuse, wherein the secondary energetic device is configured to be detonated after the perforating charge is detonated.

4. The perforating gun of claim 3, wherein the second detonation train is configured to detonate the secondary energetic device not less than 60 μs and not more than 500 μs after the perforating charge is detonated.

5. The perforating gun of claim 1, wherein the second detonating fuse has an energetic content per unit length capable of increasing the internal energy of the perforating gun after detonation of at least the perforating charge.

6. The perforating gun of claim 1, further comprising:

a charge tube housing the perforating charge;

a carrier tube in which the charge tube extends; and a fill body extending within a space defined between the charge tube and the carrier tube.

7. The perforating gun of claim 6, wherein the fill body includes a first groove in which the first detonating fuse is disposed and a second groove in which the second detonating fuse is disposed.

8. The perforating gun of claim 1, wherein the first detonating fuse comprises detonating cord.

9. The perforating gun of claim 8, wherein the second detonating fuse comprises a strip of explosives or a detonating fuse.

10. A perforating gun, comprising:

a first detonation train comprising:

a first detonating fuse; and a perforating charge, ballistically connected to the first detonating fuse and detonable by the first detonating fuse to perforate a wellbore proximate a subterranean formation; and a second detonation train that is detonable to increase an internal energy of the perforating gun after detonation of at least a portion of the first detonation train, the second detonation train comprising a second detonating fuse;

wherein the second detonation train comprises a plurality of detonable delay loops arranged in parallel and/or series with the first detonation train.

11. The perforating gun of claim 10, wherein one or more of the plurality of detonable delay loops is ballistically connected to one or more secondary energetic devices configured to be detonated after the perforating charge is detonated.

12. The perforating gun of claim 10, wherein the second detonation train further comprises a secondary energetic device ballistically connected to the second detonating fuse, wherein the secondary energetic device is configured to be detonated after the perforating charge is detonated.

13. The perforating gun of claim 12, wherein the second detonation train is configured to detonate the secondary energetic device not less than 60 μs and not more than 500 μs after the perforating charge is detonated.

14. The perforating gun of claim 10, wherein the second detonating fuse has an energetic content per unit length capable of increasing the internal energy of the perforating gun after detonation of at least the perforating charge.

15. The perforating gun of claim 10, further comprising:

a charge tube housing the perforating charge;

a carrier tube in which the charge tube extends; and a fill body extending within a space defined between the charge tube and the carrier tube.

16. The perforating gun of claim 15, wherein the fill body includes a first groove in which the first detonating fuse is disposed and a second groove in which the second detonating fuse is disposed.

17. The perforating gun of claim 10, wherein the first detonating fuse comprises detonating cord.

18. The perforating gun of claim 17, wherein the second detonating fuse comprises a strip of explosives or a detonating fuse.

19. A method, comprising:

detonating at least a portion of a first detonation train of a perforating gun;

perforating, with the first detonation train, a wellbore proximate one or more subterranean formations;

detonating, after detonating the at least a portion of the first detonation train, a second detonation train of the perforating gun; and increasing, with the second detonation train, an internal energy of the perforating gun;

wherein detonating the at least a portion of the first detonation train of the perforating gun comprises activating a first detonating fuse of the first detonation train;

wherein perforating the wellbore comprises exploding, in response to activating the first detonating fuse, a perforating charge ballistically connected to the first detonating fuse;

wherein detonating the second detonation train of the perforating gun comprises activating a second detonating fuse of the second detonation train;

and wherein activating the second detonating fuse comprises detonating one or more detonable delay loops of the second detonation train in parallel and/or in series with the first detonation train.

20. The method of claim 19, wherein increasing the internal energy of the perforating gun comprises:

exploding, in response to activating the second detonating fuse, a secondary energetic device ballistically connected to the second detonating fuse.

21. The method of claim 19, wherein the second detonating fuse is activated by detonating the at least a portion of the first detonation train.

* * * * *